US005319882A

United States Patent [19]

Biebuyck

[11] Patent Number: 5,319,882

[45] Date of Patent: Jun. 14, 1994

[54] ENTRANCE SYSTEM

[75] Inventor: Lawrence Biebuyck, Garland, Tex.

[73] Assignee: Butler Manufacturing Corporation, Kansas City, Mo.

[21] Appl. No.: 665,810

[22] Filed: Mar. 7, 1991

[51] Int. Cl.[5] ..... E06B 3/34

[52] U.S. Cl. ..... 49/371; 49/366; 49/368; 52/206; 52/455; 52/457

[58] Field of Search ..... 52/206, 455, 456, 457, 52/207; 49/366, 367, 368, 116, 117, 118, 122, 371, 381, 388

[56] References Cited

U.S. PATENT DOCUMENTS

| | | | |
|---|---|---|---|
| 1,301,704 | 4/1919 | Joyce | 49/367 |
| 1,541,272 | 6/1925 | Neilson | 49/367 |
| 2,510,832 | 6/1950 | Patterson . | |
| 3,307,294 | 3/1967 | Bienenfeld et al. . | |
| 3,827,183 | 8/1974 | Zimmerman et al. | 49/366 |
| 3,881,287 | 5/1975 | Biebuyck . | |
| 3,881,294 | 5/1975 | Biebuyck . | |
| 3,916,595 | 11/1975 | Biebuyck . | |
| 3,961,452 | 6/1976 | Hubbard et al. . | |
| 4,006,573 | 2/1977 | Biebuyck . | |
| 4,008,552 | 2/1977 | Biebuyck . | |
| 4,010,671 | 3/1977 | Hubbard et al. . | |
| 4,030,260 | 6/1977 | Sukolics et al. . | |
| 4,050,201 | 9/1977 | Hubbard et al. . | |
| 4,055,923 | 11/1977 | Biebuyck . | |
| 4,167,088 | 9/1979 | Governale . | |
| 4,194,776 | 3/1980 | Biebuyck . | |
| 4,644,717 | 2/1987 | Biebuyck . | |
| 4,720,876 | 1/1988 | Tomei et al. | 49/388 |
| 4,773,193 | 9/1988 | Biebuyck et al. . | |
| 4,899,508 | 2/1990 | Biebuyck . | |
| 4,956,954 | 9/1990 | Horgan, Jr. | 52/207 |

*Primary Examiner*—Carl D. Friedman
*Assistant Examiner*—Kien Nguyen
*Attorney, Agent, or Firm*—Johnson & Gibbs

[57] ABSTRACT

An angulated door assembly affording reduced entry and exit time and motion therethrough. Each door is angulated relative to the adjacent walls and/or the conventional path of ingress/egress therethrough. Such an assembly configuration affords increased sealing capacity as well as convenience for the user. The door opens and closes faster by swinging less than a conventional door, which presents itself orthogonally to the path of ingress/egress. By utilizing a pair of angulated doorways, the doors self-seal against each other while providing the advantages of angulated disposition relative to the path of ingress/egress.

12 Claims, 4 Drawing Sheets

ENTRANCE SYSTEM

BACKGROUND OF THE INVENTION

1. Field of Invention

The present invention relates to entrance systems and, more particularly, to an entrance system having at least one transversely disposed, angulated door relative to the walls adjacent thereto and the conventional path of ingress/egress therethrough.

2. History of the Prior Art

The prior art is replete with door and window designs for residential and commercial construction. Designs vary for both the door and the door frame depending on the type of wall construction adjacent thereto. For example, in storefront constructions, the theme of aluminum or steel and glass is generally carried through in the construction of the door and the door free. In the main, such doors and door frames provide a designated path of ingress and egress therethrough which is perpendicular to the door frame. The door itself generally comprises two vertical stiles coupled to top and bottom rails. The door frame may include a door jamb, a door header and a door threshold. However, conventional technology has afforded a wide variety of door and wall assemblies including solid glass doors that do not require either vertical stiles or door jambs for operation.

By way of example, an entrance construction is set forth and shown in U.S. Pat. No. 3,307,294 to Bienenfeld. This 1967 patent teaches an entrance construction that comprises a door assembly and frame,. the frame being formed of a thin gauge metallic material that is roll formed into a tubular configuration secured in position by an interior lock seam% An object of this particular invention is an entrance construction wherein the members thereof are formed of relatively thin gauge stainless steel material of the type utilizing special retainer clips which are welded in place. This reference is one example of the methodology of doorway construction circa 1960. An earlier reference is seen in U.S. Pat. No. 2,510,832 to C. A Patterson. This patent teaches a particular storefront construction circa 1950. The doorway includes angulated panel members adjacent the door and the patent teaches the utilization of a supporting framework furred out from the front of ( an ) existing building. Use of a prefabricated false front was said to improve the appearance of the building.

A discussion of more conventional door system construction techniques is seen in U.S. Pat. No. 4,167,088. This 1979 patent teaches a structural configuration for ingress/egress that is designed to be beth energy efficient and secure. It incorporates a fully weathers tripped, reversible door assembly having hinged door panels with an intervening strike mullion tied to continuous head and sill assemblies. This assembly emphasizes the current trend toward the design of more efficient doorway systems. This is particularly true in designs of commercial structures where pedestrian traffic often places intense demands upon the doorway system It is well recognized that the use of doors, particularly in commercial establishments, is beth a functional necessity for the commercial establishment and an aesthetic element in the appearance thereof. When a conventional doorway is used by an individual who must pull on the door to open it, that individual often has to step back while the door is in the opening phase of its operation. Once the individual completes his ingress/egress, the door must close on its own. The open position is generally on the order of 90° to 110° from its closed position Much of the door travel from the open to closed position is necessary simply to provide an opening for the user whose path of ingress/egress is generally perpendicular to the closed position of the door. The period of time that the doer is open to permit ingress/egress (herein referred to as the "swing time") directly affects the air conditioning within the building: the longer the swing time, the more air conditioning loss. To handle this situation, more sophisticated door systems have been designed. In some instances, sliding doers are utilized which are generally electrically operated and/or used in conjunction with a double doer entry area in which one door remains closed while the other is open This design prevents the direct flow of conditioned air through the doorway during the opening and closingthereof.

Moreover, there are cl ear us e and safety considerations when designing conventional door systems. The elimination of a doer swinging outwardly into a pedestrian area, such as a sidewalk, has certain advantages. For example, pedestrians are not interfered with or struck by the doer opening. Moreover, the door does not open into a wind that can catch conventional doors causing them to swing violently from the building.

Not all commercial establishments lend themselves to double doers, sealed doer areas or electric sliding doers. Moreover, some commercial establishments do not find such entry area and sliding doer assemblies economically feasible, aesthetically pleasing or consistent with the basic architectural design of their building. It would be an advantage, therefore, to overcome the problems of the prior art by providing an economical swinging door system that was aesthetically pleasing as well as functionally efficient from an energy efficiency and functionality standpoint.

SUMMARY OF THE INVENTION

The present invention relates to an improved entrance system incorporating at least one door disposed at an angle relative to the building walls adjacent thereto. This design permits the mounting of a door at an angle relative to the area of passage, also referred to as the path of ingress/egress therethrough. More particularly, one aspect of the invention includes at least one doors. By mounted in a wall, the doorway being disposed at an angle relative to the wall. The entrance may comprise a frame or jamb having vertical members connected to header and threshold members. The header and threshold members may be disposed at an angle relative to the notional plane established by the adjacent building walls. However, a door%ray comprising a solid glass door without a door jamb may also be utilizeal. In this manner, the path of passage or path of ingress/egress through the doorway, which is conventionally perpendicular to the adjacent walls, engages the door at a predefined angle. The angle of the door presents the door to the user in a sealed position that is partially open relative to the user.

In another aspect, the invention includes a building entrance and exit structure of the type wherein an ingress/egress path longitudinally extends perpendicularly across a vertical plane within which a side wall section of the building generally lies. The ingress/egress path is horizontally delimited on one side by a vertical side edge portion of the side wall section and on the other side by a vertical structure. A door is operatively mounted on either the vertical structure or the vertical side walls section edge portion for horizontal pivotal movement. The movement of the door is a closed position in which the door extends between the vertical structure and the vertical side wall section edge portion and blocks the ingress/egress path and an open position in which the door is swung essentially entirely out of the ingress/egress path. The improvement comprises the vertical structure and said vertical side wall section edge portion being offset from one another in a direction perpendicular to the vertical plane and the pivotal arc of the door from its closed position to its open position being substantially less than 90°.

In another aspect, the present invention includes an improved double door system of the type wherein first and second doors are disposed in at least one wall adjacent one another to provide a path of ingress/egress therethrough. The improvement comprises the first and second doors being disposed in the wall at an angle one to the other. The first and second doors are also mounted relative to the wall at an angle one to the other and to the wall. Means are then provided for sealing the first and second doors in a first closed position relative to each other. The first and second doors also define a triangle whose base is the notional plane connecting the outwardly extending corners of the doors. The path of ingress/egress through the doors is then substantially parallel to the height line of the triangle taken from the notional plane to the apex between the doors.

In another aspect, the double door system described above includes sealing means comprising at least one sealing member secured to the outside edge of one of the doors adapted for the abutting engagement of the opposite door. The sealing means may comprise an elastomeric member disposed between the doors at the apex of the triangle, adapted for abuttingly engaging the outside edges of the first and second doors. The angle between the first and second doors is substantially less than 180° and may be on the order of 120°. In such a configuration, pedestrians will be able to see a user of the door prior to its opening.

In yet another aspect, the invention includes a method of providing improved ingress/egress from a building. The method comprises the steps of providing first and second doors in at least one wall disposed at an angle relative to one another and the wall, and providing the doors for angulated positioning relative to the building to therein establish a path of ingress/egress therethrough The first and second doors are hingedly mounted relative to the adjacent wall or walls to thereby permit outward opening of the doors from a central apex therebetween. The apex configuration of the doors is disposed along a notional plane substantially parallel to the egress wall of the building. A path of ingress/egress is then defined through the angulated doors substantially perpendicular to the egress wall of the building. Finally, means are provided in certain embodiments of the invention for sealing the first and second doors against one another for inhibiting the infiltration of air therebetween.

In a further aspect, the invention includes an improved, energy efficient doorway of the type wherein at least one pivotally mounted door is mounted for hinged movement relative to an adjacent wall, and wherein sealing means are provided about the door for preventing the infiltration of air therethrough. The improvement comprises the door being disposed at an angle relative to the notional plane of the building defining the area of egress. A path of egress is defined through the door in a direction generally perpendicular to the notional plane, and egress through the door is permitted by the opening thereof at an angle less than 90°. This design facilitates the closure of the door in less time than would be necessary for a door opened more than 90°. In one embodiment, the door frame is disposed at an angle on the order of 30° relative to the notional plane of the building. With such a door opened parallel to the path of the user, the time for door closure should be reduced by about 30% relative to a conventional door opened to the same position and closing at the same speed.

BRIEF DESCRIPTION OF THE DRAWINGS

For a more complete detailed description of the construction and operation of the present invention, reference is now made to the following description, taken in conjunction with the accompanying drawings, in which.

DETAILED DESCRIPTION

Figure 1:
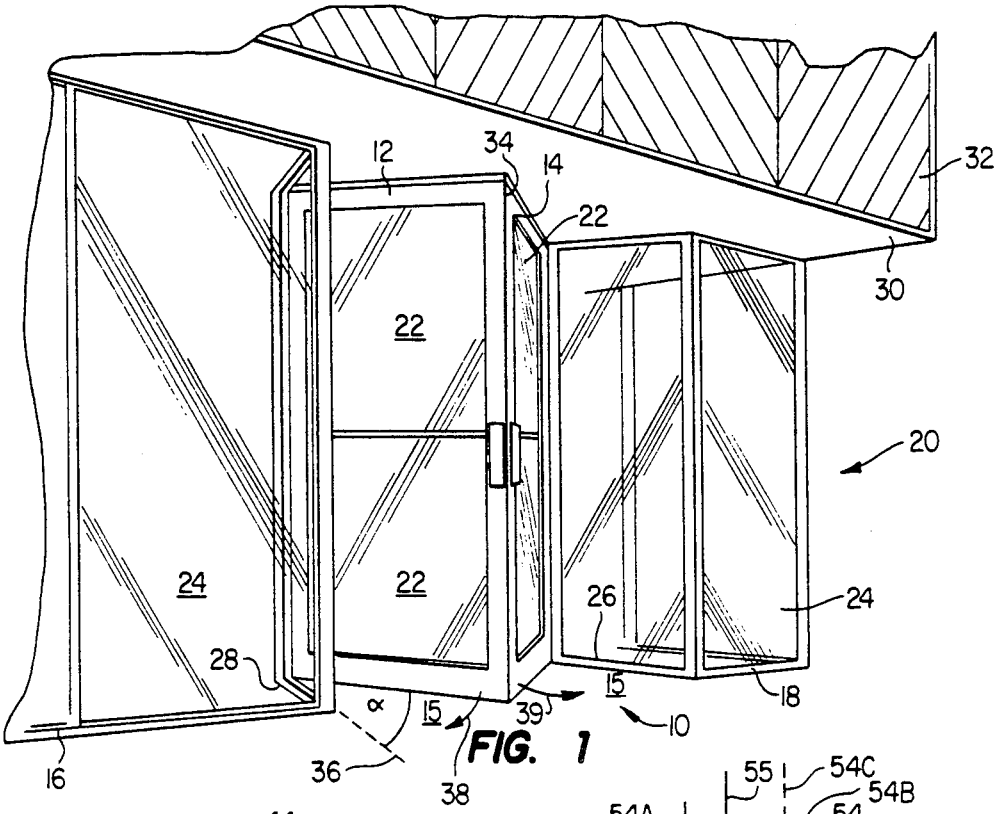
FIG. 1 is a perspective view of an entrance system constructed in accordance with the principles of the present invention.

Referring first to FIG. 1, there is shown an entrance or door system 10 constructed in accordance with the principles of the present invention. Door system 10 comprises first and second doors 12 and 14, respectively, forming a path of ingress and/or egress 15 therethrough The term "path of egress" shall be used herein collectively to mean the path of passage, including the "path of ingress" and/or "path of egress". The doors 12 and 14 of said path of egress are disposed between adjacent side walls 16 and 18 which are disposed perpendicular to said path of egress. The doors and sidewalls form the frontal region of a building 20.

Still referring to FIG. 1, the doors 12 and 14 of this particular embodiment are each formed with glass panels 22. Likewise, the building 20 of the present illustration includes a frontal wall region having glass panels 24 disposed therein. These constructions are shown for purposes of illustration only. In the present invention, the doors 12 and 14 are recessed within the frontal walls 16 and 18 by virtue of the angulated wall regions 26 and 28, as shown therein. The angulated wall regions 26 and 28 define the outside boundaries of the path of egress 15 as well as the hinge area of each of the doors 12 and 14, as will be described in more detail below. This recessed door configuration is disposed beneath a building overhang 30, above which a building face 32 is shown. In this configuration, the path of egress 15 is disposed beneath the overhang 30, whereby doors 12 and 14 meet along vertical intersection 34. Each door 12 and 14 opens from intersection 34 a distance defined by the angle alpha, labeled 36 therein Door 12 opens in the direction of arrow 38 and door 14 opens in the direction of arrow 39. It may be seen that an individual either entering or leaving the building 20 is required to open one of the doors 12 or 14 a distance which is substantially less than if the doors were perpendicular to the path 15. The doors 12 and 14 are, in effect, partially opened (relative to the user) at the time a person enters the path 15. I n accordance with the present design, however, the doors 12 and 14 provide a closed, sealed engagement with the building 20 across intersection 34 by virtue of the design. These aspects will be described in more detail below.

Figure 2A:
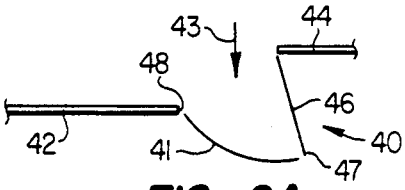
FIGS. 2A–2G are diagrammatic top plan views of alternative embodiments of entrance systems constructed in accordance with the principles of the present invention.

Referring now to FIGS. 2A through 2G, diagrammatic illustrations of alternative door configurations are shown. In FIG. 2A a single door system 40 is disposed between transversely offset side walls 42 and 44. The door 46 opens with an end 47 thereof moving across the path defined by line 41. The end 47 of the door 46 abuts the end 48 of wall 42 in the closed position It may be seen that door 46 thus presents itself in an angulated position relative to walls 42 and 44, as well as to a person on a path of travel 43 passing between said walls 42 and 44. Arrow 43 is drawn orthogonal to walls 42 and 44 and is representative of a person's normal path of egress through a doorway disposed in a generally planar wall region.

Figure 2B:
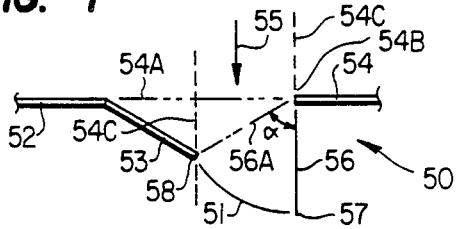

Referring now to FIG. 2B, there is shown a door system 50 disposed between adjacent walls 52 and 54. A single door 56 is shown forming a closure member between angulated wall section 53 of wall 52 and wall 54. The closed door position is shown by phantom line 56A End 57 of door 56 moves across the path of travel 51 and closes against end 58 of wall section 53. In this configuration, adjacent walls 52 and 54 define therebetween notional plane 54A (shown in phantom) which is perpendicular to path of egress 55. The advantages of the "pre-opened" door 56 are clearly shown by the fact that the opening angle alpha defined between closed door position 56A and the open door 56 is substantially less than 90°, even when the door 56 is fully opened parallel to the path of egress. In many of the drawings herein, such as FIG. 2A, the door 46 is shown opened to a degree beyond being simply parallel to the path of egress. This particular illustration shows the normal position that a door attains from passage therethrough. Few individuals will open a door precisely to the point where the door is parallel to the path of egress. However, for purposes of discussion, reference may be made to a door opening that is parallel to the path of egress, such as that shown in FIG. 2B.

Still referring to FIG. 2B, the description of the ingress/ egress structure may be defined with additional nomenclature of the type used in certain of the claims following this description. For example, the sidewall section 54 of the building may be said to have a horizontally extending portion disposed generally in a vertical plane having an outer vertical edge portion 54B. A vertically extending structure 53 may be said to be spaced apart from the outer vertical edge portion 54B for delimiting therewith the maximum width shown between dotted lines 54C and measured in a horizontal direction along or parallel to the vertical plane 543. In other words, a person walking in the direction of the path of 55 will intersect the notion plane 54A with the width of that person's path limited by the horizontal distance between edges 58 and 54B, as measured along the notional planes 54A. A door member 56 is operatively hinged to the outer vertical edge 54 B for pivotal movement relative thereto. The door may also be hinged to the vertically extending structure edge illustrated as 65A in FIG. 2C. In either case, the door is hinged between a closed position in which it extends between the vertically extending structure and the outer vertical edge portion. In FIG. 2B, this is shown by the phantom door 56A, which in this position 56A blocks the ingress/egress path. In the open position, shown by the door 56, the maximum width of the ingress/egress path is unencroached upon by the door 56. The vertically extending structure and the outer vertical edge 54B of the sidewall 54 are positioned relative to the vertical plane 54A such that the arc alpha through which the door 56 pivots from the closed position to the open position is substantially less than 90°, as shown herein This same description can be made relative to several other of the illustrations herein wherein the door is mounted for pivotal movement between the outer vertical edge of the wall and a vertically extending structure, such as structure 53 extending from wall 52 of FIG. 2B.

Figure 2C:
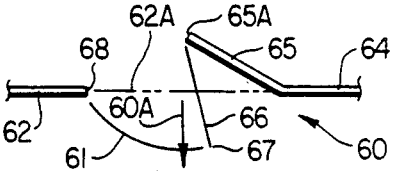

Referring now specifically to FIG. 2C, a door system 60 is disposed between walls 62 and 64. A single door 66 provides a closure member between said walls and is hingedly mounted to wall section 65, along vertically extending structure edge 65A, angularly disposed from wall section 64. The end 67 of door 66 closes against end 68 of wall 62 across path of travel 61, as shown herein It may be seen that walls 62 and 64 are likewise disposed across a common notional plane 62A (shown in phantom) whereby the "pre-opened" configuration of door 66 is provided by the angulated wall section 65 against which door 66 is hingedly mounted. Again the path of egress 60A is perpendicular to the notional plane 62A affording the same benefits as discussed above.

Figure 2D:
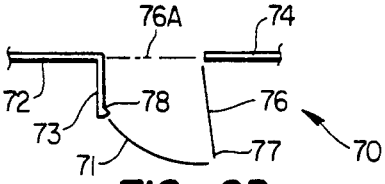

Referring now to FIG. 2D, there is shown an entrance, or door system 70 disposed between adjacent walls 72 and 74. A door 76 is hingedly mounted to wall 74, closing against orthogonal wall section 73 formed along wall 72. End 77 of door 76 engages end 78 of wall section 73 across path of travel 71. In this manner an angulated closure member is provided in doorway 70 by virtue of the orthogonal section 73 which transversely displaces the door jamb of end 78 from wall 72. This configuration permits the closure of door 76 in an angulated position relative to the notional plane 76A defined across walls 72 and 74.

Figure 2E:
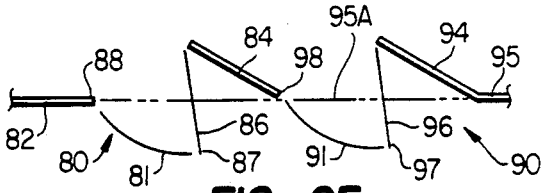

Referring now to FIG. 2E, there is shown a combination of doorways 80 and 90 formed between adjacent walls 82 and 95. Doorway 80 comprises a door 86 hingedly mounted to intermediate, angulated wall section 84, which wall section 84 is disposed in generally parallel spaced relationship with angulated wall section 94 extending from wall 95. Door 86 has an end 87 which moves across path of travel 81 to form a closure with door jamb section 88 disposed on the end of wall 82. Similarly, doorway 90 is comprised of a door 96 having an end 97 which has a path of travel 91 for closure against door jamb 98 disposed on the end of intermediate wall section 84. It may be seen in this configuration that walls 82 and 95 are disposed in a common notional plane 95A with generally parallel spaced wall sections 84 and 94 providing the requisite transverse offset therefrom for pivotal or hinged connection of doors 86 and 96, respectively, and the "pre-opened" access therethrough. In this configuration, an individual approaching either doorway 80 or 90 with a path of travel general 1 y orthogonal to the common notional plane 95A would meet either door 86 or 96 in an angled, partially open relationship as described above.

Figure 2F:
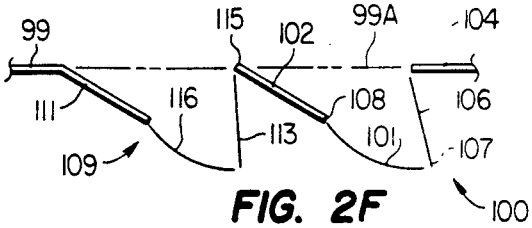
Figure 2G:
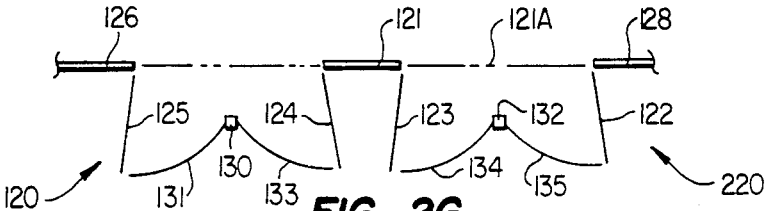

Referring now to FIG. 2F, there is shown an alternative embodiment of a combination door system comprising doorways 100 and 109. Doorways 100 and 109 are disposed between adjacent wall sections 99 and 104 and are comprised of doors 113 and 106. Door 113 is hingedly connected to an angulated intermediate wall section 102 that is disposed in generally parallel spaced relationship from a wall section 111 angularly extending from wall face 99. Door 113 has a path of travel 116 for closure against wall section 111. Door 113 is hingedly connected at end 115 of intermediate wall 102. End 108 of wall 102 provides the closure jamb for door 106 whose path of travel 101 brings said door into engagement thereagainst in the closed mode. End 107 of door 106 is thus shown disposed adjacent to the path of travel 101. It may be seen in this particular configuration that wall sections 99 and 104 are again disposed in a common notional plane 99A, and this embodiment is a modification of the doorway system shown in FIG. 2E.

Referring now to FIG. 2G, there is again shown a combination door system for double doors 120 and 220. In this double door combination system, first and second double doors 120 and 220 are disposed adjacent one another between walls 126 and 128. Intermediate wall section .121 is disposed therebetween and is positioned in a common notional plane 121A with wall sections 126 and 128. Doorway 120 is comprised of doors 124 and 125 disposed to close against a transversely offset closure member 130. Closure member 130 may comprise a central upstanding jamb member which provides a surface against which both doors 124 and 125 may abut. The path of travel of doors 124 and 125 is shown by closure paths 133 and 131, respectively. Likewise doorway 220 is comprised of doors 122 and 123 whose closure paths 135 and 134, respectively, illustrate their closed engagement against a central jamb member 132. It may be seen in this particular configuration that no additional wall sections are necessary for providing the advantages of a partially open door in accordance with the principles of the present invention.

Referring now to FIG. 2A through 2G in combination, it should be noted that the present invention contemplates the provision of a partially open, yet sealed, doorway wherein the closure door jamb is transversely offset in the manner shown in these illustrations. In this broad aspect of the invention, a multitude of variations are possible. A number of these specific doorway configurations are likewise provided as specific advances over the prior art which afford the occupants of a building the ability to easily obtain ingress and/or egress without the requirement of pulling the door back into the path of ingress or egress, as is so often necessary. It is for this reason that many commercial establishments utilize doors that swing in both directions (double swing doors ), thereby affording the user the ability to simply meet the door of the doorway and push said door in the direction of travel.

The above-referenced double swing doors have found wide spread acceptance in commercial building. However, the configuration is limited from a geometrical standpoint due to the fact that, when the user meets the door, his path of travel is perpendicular to the door, thus requiring the door to swing the maximum amount in order to afford free passage therethrough. For example, a user carrying a large article would require a conventional door to open a full 90° to 120° to permit open access therethrough. This event can create numerous problems. The time in which the door is open creates an air conditioning problem in view of the fact that the outside air is permitted to flow into the building through the doorway. The user may not be seen by others outside the door until the door is being opened Moreover, from a full open position, it is easy for wind to catch a conventional door and cause it to swing violently against its hinges or against people who are around the door.

The present invention overcomes these problems by presenting a "partially open" door to a user, whose path is generally orthogonal to the notional plane of the adjacent walls, at an angle from which the door may be further opened for passage therethrough, which opening may be accomplished with a much smaller opening angle and an equivalent passage width provided therein.

Figure 3A:
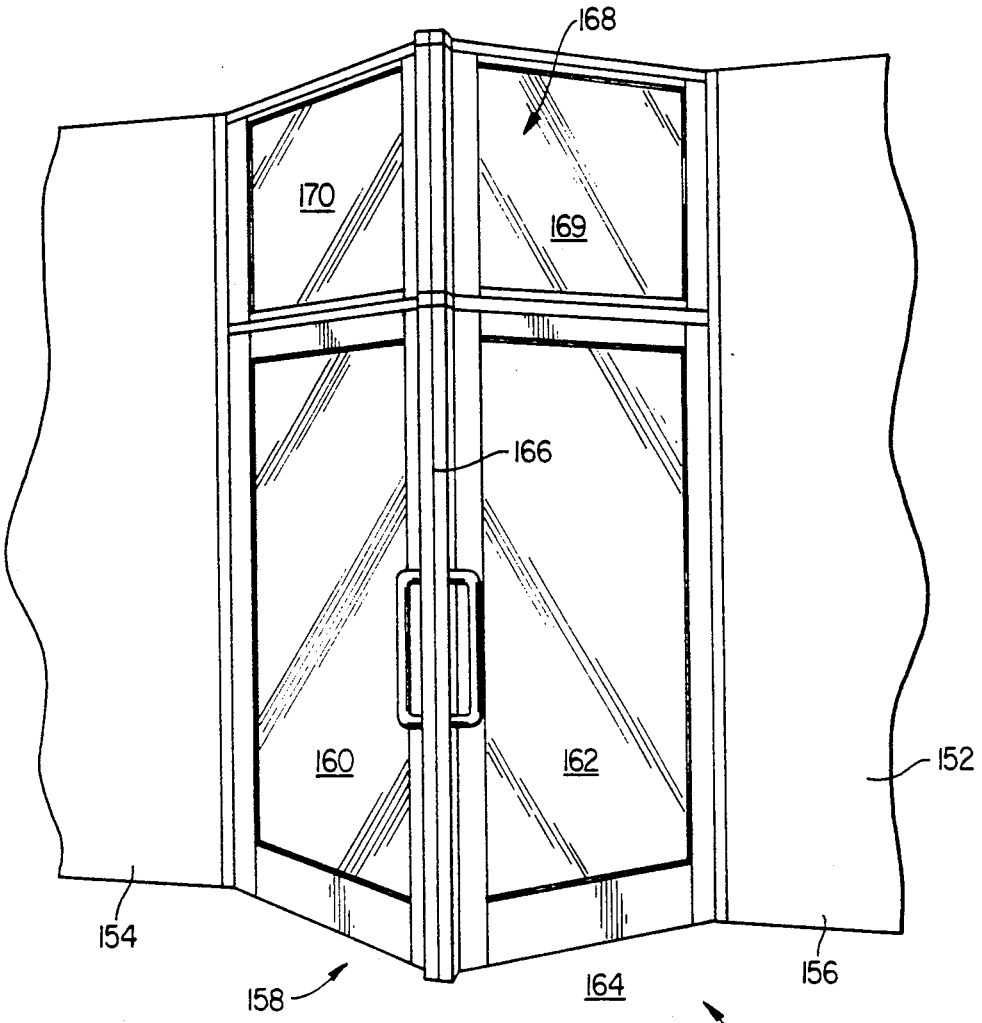
FIGS. 3A and 3B are perspective and top plan views, respectively, of a double door system constructed in accordance with the principles of the present invention.

Referring now to FIG. 3A, there is shown a perspective view of an alternative embodiment of an entrance or door system 150 constructed in accordance with the principles of the present invention Door system 150 is installed within a building 152 having side walls 154 and 156 disposed adjacent a doorway 158. Doorway 158 is comprised of first door 160 and second door 162 disposed about a path of egress 164. Doors 160 and 162 are angulated relative to the adjacent walls 154 and 156 and close one against the other across a central line of intersection 166. Architecturally, the building 152 is constructed with an upper doorway facade 168 comprising panels 169 and 170 disposed above doors 162 and 160, respectively. Any number of structures would be possible for positioning above the doors of the present invention. The specific structure would depend on the building and the doors themselves. Such facade designs would be obvious to those skilled in the art when given a particular doorway configuration It may also be seen that in this configuration egress from the building 152 through the double doors 162 and 160 is greatly facilitated, particularly in view of the absence of any intermediate closure member such as that shown in FIG. 2G above.

Figure 3B:
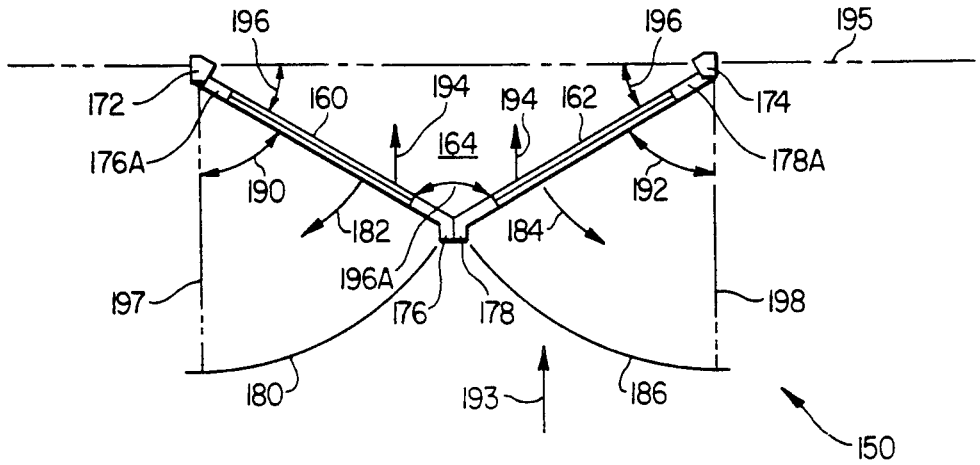

Referring now to FIG. 3B, there is shown the door assembly 150 wherein path of egress 164 is shown beneath doors 160 and 162. Door 160 is pivotally mounted against a wall member 172, with door 162 hingedly mounted against wall member 174. The doors 160 and 162 are each constructed with a vertical lock stile adapted for matingly abutting the vertical lock stile of the opposite door. Door 160 is thus constructed with a vertical lock stile 176 which is adapted for matingly abutting lock stile 178 of door 162. Stiles 176 and 178 are formed in an angulated relationship as defined in more detail below. Each door in this illustration is also constructed with a hinge, or pivot stiles 176A or 178A.

The angulated relationship provides for sealed engagement therebetween and comprises a closure member facilitating the angulated door configuration as shown in this illustration. The outside end of door 160 comprising stile 176 has a path of travel 180 when door 160 is opened in the direction of arrow 182. Likewise door 162, when opened in the direction of arrow 184, affords stile 178 a path of travel along line 186. It may be seen that the opening of door 160 through the angle 190 and the opening of door 162 through the angle 192 provides full access for the user between wall members 172 and 174. This full opening for passage therethrough is provided with each angle 190 and 192 substantially less than 90°. This aspect is a marked advance over prior art door assemblies in view of the fact that the doors remain open for a shorter period of time during ingress and egress. Moreover, in the configuration shown herein, the abutting close between stiles 176 and 178 provides a self-sealing configuration which enhances the ability of the doorway 150 to seal against wind by virtue of the fact that any wind in the direction of arrow 193 will cause a pressure on the door in the direction of arrow 194. Such pressure will cause the stiles 176 and 178 to press against one another to enhance sealing even more. Each of the lock stiles 176 and 178 may include a sealing gasket to enhance the sealing thereacross as described in more detail below.

Still referring to FIG. 3B, it may be seen that this particular door configuration affords the user the ability to quickly and easily pass through the path of egress 164 with a minimal opening of doors 160 and 162. With the present invention, both doors may be opened simultaneously to afford the user quick passage and even less door opening time and distance. It may be seen that the angle of doors 160 and 162, relative to the notional plane of a wall structure 195, is on the order of 30° as shown herein. Thus, angle 196 defines the "pre-opening" angle of doors 160 and 162. It is that "pre-opening" angle which directly benefits the user by presenting the doorway 150 to the user with doors 160 and 162 pre-opened by the angle 196. It may be seen that, if doorways 160 and 162 are opened vertically against opening lines 197 and 198, the degree of opening 190 and 192 is substantially less than the conventional 90 degree opening necessary for conventional doors. The time that it takes for a door to close the distance defined by angle 196 is thus the improvement time afforded by the utilization of such doors.

Still referring to FIG. 3B, yet another angle 196A is shown. Angle 196A is that angle formed between the intersection of the doors 160 and 162 at the apex thereof. It may be seen that angle 196A, comprising an angle of intersection between said doors at the apex thereof, is substantially less than 180°. A 180° angle defines a straight line of intersection of the type that is conventional for double doors, particularly double glass doors in commercial buildings. One of the advantages of the present invention is the positioning of said doors in a first closed position with the-angle at the apex therebetween being substantially less than 180°. As shown herein, for purposes of illustration, an angle on the order of 120° may be used. This feature affords the advantages in a double door system as defined herein as well as the advantages of the other angular "pre-opened" door relationships discussed above.

Figure 4:
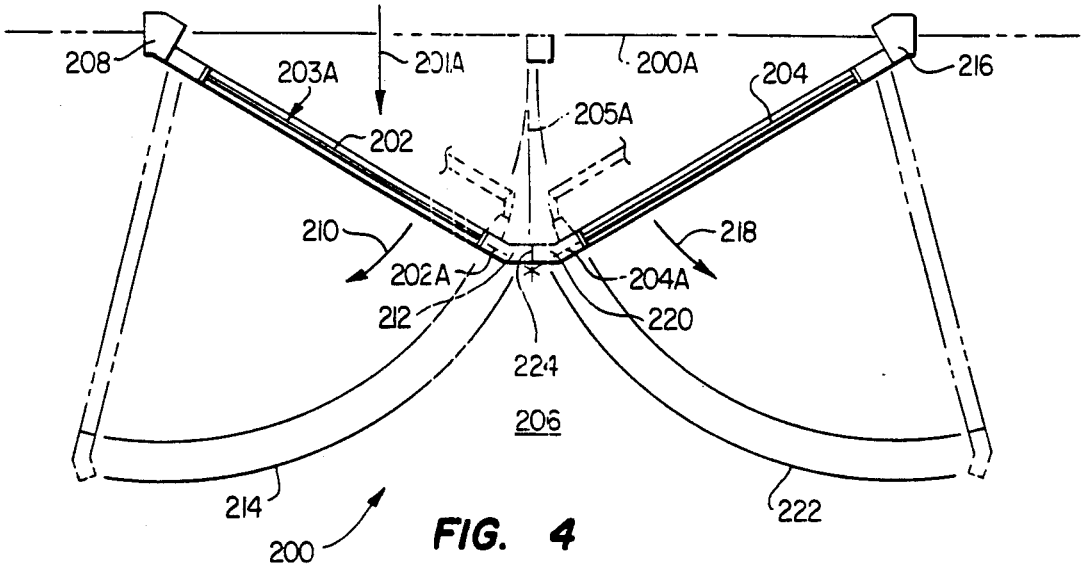
FIG. 4 is an enlarged, top plan view of an alternative embodiment of the door assembly of FIGS. 3A and 3B illustrating the operation thereof.

Referring now to FIG. 4, the doors of the present invention provide means for facilitating egress from a building by virtue of their angulated presence relative to the notional plane defined by the wall of the building around the path of egress. This notional plane is shown as phantom line 200A. The path of egress from a building is generally perpendicular to the notional plane of said wall although it does not have to be. This path of egress is shown as line 201A. It may be seen that the path of egress 201A is substantially parallel to the height line 205A of the triangle 203A defined by the notional plane 200A and the center lines 204A and 204A of the doors 202 and 204, respectively. The apex of triangle 203A is formed at the point where said doors meet. The height line 205A is an imaginary line drawn from notional plane 200A at right angles thereto, to said apex. This geometrical principle is utilized herein to define certain parameters of the present invention For purposes of the present application, the notional plane 200A is defined as that plane which is generally established by the structure of the building wall. In this manner it should be noted that an atrium or similar smaller area of egress or dwelling could have wall angles that are not necessarily parallel to, or defined by, said notional plane. However, the path of an angulated egress is readily apparent in a building, and the presence of angulated walls around the door jamb will not inhibit the effectiveness of the present invention.

Still referring to FIG. 4, there is shown a doorway 200 comprised of first door 202 in abutting engagement with a second door 204. Doors 202 and 204 are, in their closed position, in angulated engagement one with the other. Together doors 202 and 204 comprise the closure member across path of egress 206. Door 202 is hingediy mounted to wall frame member 208 and is adapted for opening in the direction of arrow 210. The vertical lock stile of door 202 is angulated closing element 212 whose path of travel is indicated by lines 214 when said door is opened in the direction of arrow 210. Likewise door 204 is hingedly connected to wall frame member 216 and opens in the direction of arrow 218; with lock stile 220 moving along path 222 indicated across path of egress 206. When doors 202 and 204 are closed, they meet at a line of intersection 224. Pressure upon doors 202 and 204 may be seen to cause compression along line of intersection 224 as described above.

Figure 5:
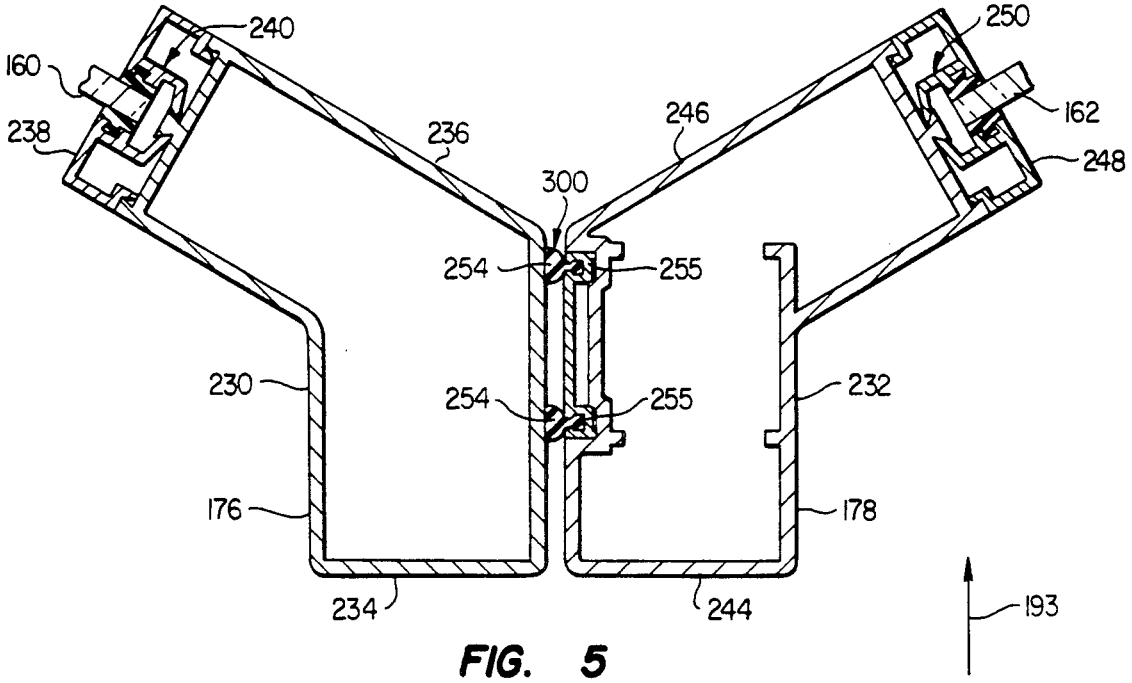
FIG. 5 is an enlarged, top plan cross sectional, fragmentary view of the closure members of the entrance system of FIG. 3B illustrating one aspect of the assembly thereof.

Referring now to FIG. 5, there is shown an enlarged, cross-sectional view of doors 160 and 162 of FIG. 3B. Stiles 176 and 178 are shown to be constructed, in this particular embodiment, of metal, such as aluminum extruded into a configuration particularly adapted for the door stile construction. Stile 176 is comprised of a hollow housing 230 having a frontal or outside member 234 and a rear or inside surface 236. Likewise member 178 is comprised of a hollow housing 232 having a frontal or outside member 244 and, a rear or inside surface 246. Member 230 is further constructed with an end 238 constructed for mounting a glass pane, or the like, comprising the body of door 160. The mounting structure 240 i s shown herein for purposes of illustration only. Likewise member 232 is constructed with an end 248 having a mounting structure 250 disposed therein for the mounting of a glass panel or the like for door 162. Of particular import, it is seen that the interface 300 between said doors is constructed with a pair of sealing members 254 affording a sealed engagement therebetween. Sealing members 254 are conventional gaskets secured within recesses 255 formed in member 244. As discussed above, when pressure is applied in the direction of arrow 193, the hinged movement of the doors will cause compression of sealing members 254 to further enhance the seal across interface 300 and prevent infiltration of air therethrough.

Figure 6:
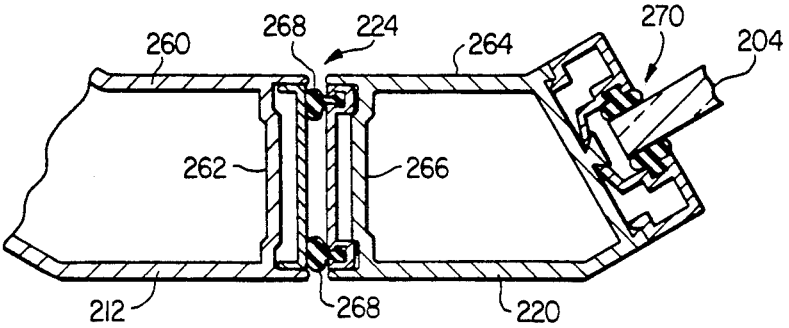
FIG. 6 is an enlarged, across sectional, fragmentary view of the door closure members of the doors of FIG. 4 for illustrating the assembly thereof.

Referring now to FIG. 6, there is shown an enlarged top plan, cross-sectional view, of the mating region 224 of doors 202 and 204 shown in FIG. 4. In this particular view the lock stiles 2 12 and 220 of said doors are shown in abutting engagement with the provision of appropriate sealing members therebetween. Member 212 is comprised of a generally hollow housing 260 having an end 262 abuttingly engaging end 266 of hollow member 264 of member 220. A pair of elastic sealing members or gaskets 268, formed from conventional doorway sealing material, are disposed therebetween for providing a seal against air infiltration. Member 220 is also constructed with an end 270 adapted for the mounting of a glass panel or the like. It may be seen that any number of construction configurations are possible in accordance with the principles of the present invention. The particular configurations illustrated in FIGS. 5 and 6 are for purposes of illustrating the abutting engagement and sealing mechanism for such a door. The doors are constructed with the specific design configuration of an intermediate sealing member affording the ability of the door assembly to seal against air infiltration by the self abutting relationship therebetween.

Figure 7:
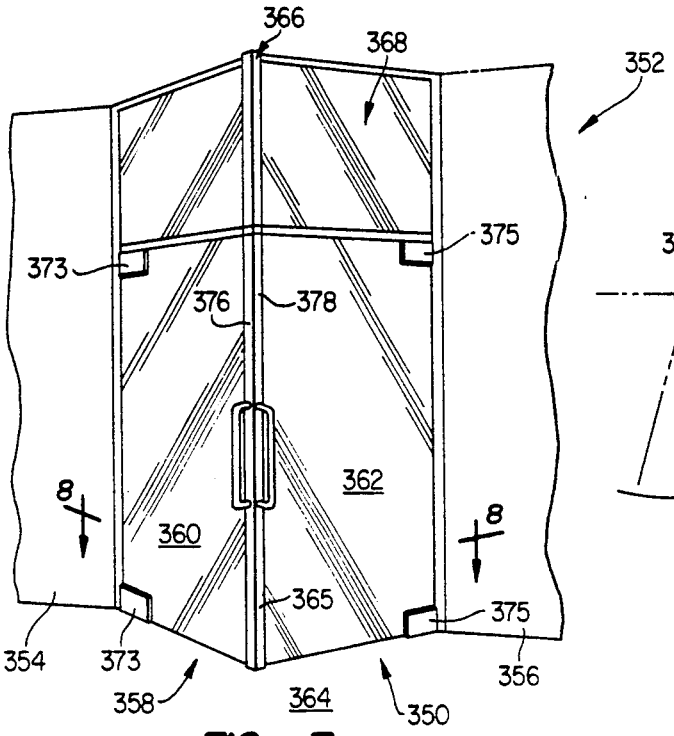
FIG. 7 is a perspective view of one embodiment of an entrance system of the present invention constructed with solid glass door panels and without a door frame.
Figure 8:
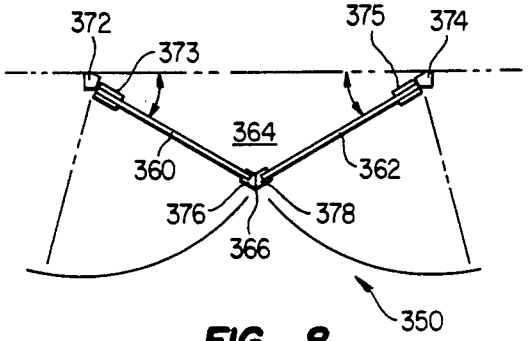
FIG. 8 is a top plan view of the entrance system of FIG. 7, illustrating the operation thereof.

Referring now to FIG. 7, there is shown a perspective view of an alternative embodiment of a door system 350 constructed in accordance with the principles of the present invention. Door system 350 is installed within a building 352 having side walls 354 and 356 disposed adjacent a doorway 358. Doorway 358 is comprised of first, solid glass door 360 and second, solid glass door 362 disposed about a path of egress 364. Doors 360 and 362 are each constructed with only lock stiles 376 and 378 and are angulated relative to the adjacent walls 354 and 356. The doors close one against the other across a central line of intersection 366. A closure sealing member (not shown in this view) is provided between lock stiles 365 in order to reduce unwanted air infiltration The building 352 is also constructed with an upper doorway facade 368 as described above for FIG. 3A Referring now to FIG. 8, there is shown a top plan view of the door assembly 350 of FIG. 7 wherein path of egress 364 is shown beneath doors 360 and 362. Door 360 is hingedly mounted to wall member 372 by a conventional pair of hinge shoes 373, with door 362 hingediy mounted to wall member 374 by a conventional pair of hinge shoes 375. The doors 360 and 362 are each constructed of solid glass with stiles 376 and 378 adapted for matingly abutting each other. The doors 360 and 362 open in the manner described above for doors 160 and 162 of FIG. 3. It may be seen further that a variety of door constructions are possible in accordance with the principles of the present invention With the glass doors as shown herein, a wide range of visibility is afforded without the problems associated with conventional door designs.

Figure 9:
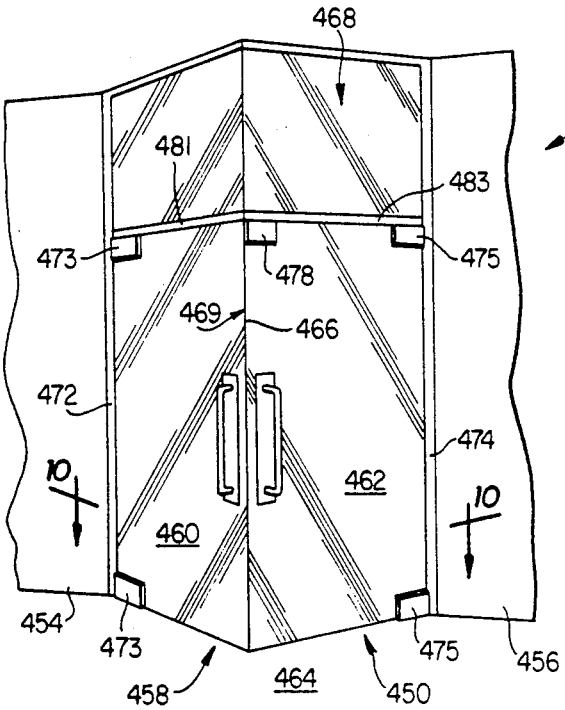
FIG. 9 is a perspective view of an alternative embodiment of the entrance system of the present invention constructed with solid glass panels.

Referring now to FIG. 9, there is shown a perspective view of an alternative embodiment of a glass door system 450 constructed in accordance with the principles of the present invention and without any door stiles. Door system 450 is installed within the building 452 having side walls 454 and 456 disposed adjacent doorway 458. Doorway 458 is comprised first, solid glass door 460 and second, solid glass door 462 disposed about a path of egress 464. Doors 460 and 462 are each constructed of solid glass without stiles, rails or closure members and are angulated relative to the adjacent walls 454 and 456. The doors close one against the other across a central line of intersection 466. No closure seal is provided in this particular configuration and a space 469 is provided therebetween. The position of each door in the closed position is controlled by the headers 481 and 483 disposed thereabove. Also, architecturally, the building 452 is constructed with an upper doorway facade 468 as described above for FIG. 3A. It may also be seen that the door system 450 is also constructed with hinge shoes 473 and 475. Metal housings are conventionally used for both hinge shoes and locking member 478. The metal housings may be provided in stainless steel or chrome, for example, and they are typically disposed on the corners of the glass door panels as is conventional with the manufacturer of glass doors. This particular configuration is but one suggested embodiment of the present invention.

Figure 10:
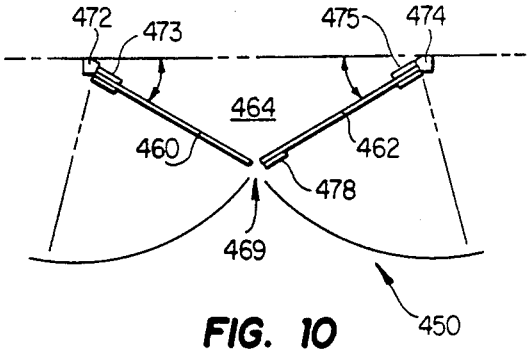
FIG. 10 is a top plan view of the entrance system of FIG. 9, illustrating the operation thereof.

Referring now to FIG. 10, there is shown a top plan view of door assembly 450 wherein path of egress 464 is shown beneath doors 460 and 462. Door 460 is hingedly mounted to wall member 472, with door 462 hingedly mounted to wall member 474. The space 469 between the doors is conventional with certain prior art solid glass doors which are mounted in a coplanar configuration The doors 460 and 462 of the present invention do, however, open in the manner described above for doors 160 and 162 of FIG. 3A.

Having described the invention in connection with certain specific embodiments thereof, it is to be understood that further modifications may now suggest themselves to those skilled in the art and it is intended to cover such modifications as fail within the scope of the appended claims.

What is claimed is:

1. An improved personnel double door system of the type wherein first and second doors are disposed relative to at least one wall of a building and adjacent one another to provide a path of personnel egress therethrough when the doors are opened outwardly, the improvement comprising:

said first and second doors being disposed at an angle one to the other and forming an apex therebetween, wherein said apex projects outwardly from said building and said doors open outwardly from said building for personnel egress therethrough;

said first and second doors defining, in a first, closed position, a triangle whose base is a notional plane connecting the outwardly extending corner thereof; and said path of personnel egress through said doors into and out of said building being substantially parallel to the height of said triangle defined by a straight line perpendicular to said notional plane and passing through said apex between said doors.

2. The apparatus as set forth in claim 1 and further including means for sealing said first and second doors in said first closed position relative to each other and along said apex.

3. The apparatus as set forth in claim 2 wherein said sealing means comprises an elastomeric member disposed between said doors at the apex of said triangle, adapted for abuttingly engaging said first and second doors.

4. The apparatus as set forth in claim 1 wherein said doors are constructed substantially of glass for permitting visibility therethrough.

5. The apparatus as set forth in claim 1 wherein said doors are constructed within door frames disposed at an angle one to the other.

6. The apparatus as set forth in claim 1 wherein said doors are constructed with lock stiles for securing the closure thereof.

7. The apparatus set forth in claim 6 wherein said door further includes at least one sealing member secured to said lock stile of one of said doors adapted for the abutting engagement of the opposite one of said lock stiles of said other door.

8. The apparatus as set forth in claim 1 wherein said angle of said first and second doors is substantially less than 180°.

9. In a building for personnel having a side wall section, a major portion of which lies generally in a vertical exterior plane, a personnel entrance and exit portion comprising, in plan view, a generally V-shaped structure projecting outwardly from said building horizontally beyond said vertical plane, said generally V-shaped structure being substantially defined by outwardly opening door members supported along a vertical side edge thereof for horizontal pivotal movement relative to the inside corners of said generally V-shaped structure for personnel ingress and egress therethrough.

10. The apparatus as set forth in claim 9 wherein both legs of said generally V-shaped structure are substantially defined by door members pivotally supported along oppositely disposed vertical side edges.

11. An improved personnel double doorway assembly of the type wherein first and second doors are mounted in an egress wall of a building for outwardly opening hinged movement to permit personnel ingress and egress therethrough into and out of said building, the improvement comprising:

said first personnel door being mounted at an angle relative to said second personnel door, the point of intersection therebetween occurring at an apex which projects outwardly from said building;

said first and second personnel doors each being disposed at an angle relative to a notional plane extending along the egress wall of said building and adapted for opening outwardly of said building;

the distance from said apex to said notional plane and perpendicular thereto being defined as the apex offset path; and said path of personnel egress from said building through said personnel doors being substantially parallel to said apex offset path.

12. The apparatus set forth in claim 11 wherein said first and second doors are disposed for abutting engagement in a first closed position therebetween, and further including a sealing member being disposed upon at least one door for affording sealed engagement therewith.

* * * * *

UNITED STATES PATENT AND TRADEMARK OFFICE

CERTIFICATE OF CORRECTION

PATENT NO. : 5,319,882

DATED : June 14, 1994

INVENTOR(S) : Lawrence Biebuyck

It is certified that error appears in the above-indentified patent and that said Letters Patent is hereby corrected as shown below:

Column 1, line 18: Delete "free"; insert --frame--

Column 1, line 34: Delete "seam%"; insert --seam.--

Column 1, line 51: Delete "beth"; insert --both--

Column 1, line 52: Insert a hyphen after --weathers--

Column 1, line 59: Insert a period after --system--

Column 1, line 61: Delete "beth"; insert --both--

Column 2, line 2: Insert a period after --position--

Column 2, line 12: Delete "doers"; insert --doors--

Column 2, line 13: Delete "doer"; insert --door--

Column 2, line 15: Insert a period after --open--

Column 2, line 17: Delete "closingthereof"; insert --closing thereof--

Column 2, line 18: Delete "cl ear" insert --clear--

Column 2, line 18: Delete "us e"; insert --use--

Column 2, line 20: Delete "doer"; insert --door--

Column 2, line 23: Delete "doer"; insert --door--

Column 2, line 27: Delete "double doers"; insert --double doors--

Column 2, line 27: Delete "doer"; insert --door--

Column 2, line 27: Delete "sliding doers"; insert --sliding doors--

Column 2, line 29: Delete "doer"; insert --door--

Column 2, line 47: Delete "doors. By"; insert --doorway--

Column 2, line 53: Delete "door%ray"; insert --doorway--

UNITED STATES PATENT AND TRADEMARK OFFICE

CERTIFICATE OF CORRECTION

PATENT NO. : 5,319,882
DATED : June 14, 1994
INVENTOR(S) : Lawrence Biebuyck

It is certified that error appears in the above-indentified patent and that said Letters Patent is hereby corrected as shown below:

Column 2, line 55: Delete "utilizeal"; insert --utilized--

Column 3, line 2: Delete "walls"; insert --wall--

Column 3, line 49: Insert a period after --therethrough--

Column 4, line 37: Delete "across"; insert --cross--

Column 4, lines 56-7: Insert a period after "therethrough"

Column 5, line 14: Insert a period after --therein--

Column 5, line 22: Delete "I n"; insert --In--

Column 5, line 33: Insert a period after --position--

Column 5, line 45: Insert a period after --56A--

Column 6, line 8: Delete "543"; insert --54A--

Column 6, line 14: Delete "54 B"; insert --54B--

Column 6, line 30: Insert a period after --herein--

Column 6, line 42: Insert a period after --herein--

Column 7, lines 13-14: Delete "general 1 y"; insert -- generally--

Column 7, line 41: Delete ".121"; insert --121--

Column 8, line 20: Insert a period after --opened--

Column 8, line 35: Insert a period after --invention--

Column 8, line 50: Insert a period after --configuration--

Column 9, line 18: Delete "close"; insert --closure--

Column 9, line 59: Delete "the-angle"; insert --the angle--

UNITED STATES PATENT AND TRADEMARK OFFICE

CERTIFICATE OF CORRECTION

PATENT NO. : 5,319,882

DATED : June 14, 1994

INVENTOR(S) : Lawrence Biebuyck

It is certified that error appears in the above-indentified patent and that said Letters Patent is hereby corrected as shown below:

Column 10, line 9: Delete "204A and 204A" insert --202A and 204A--

Column 10, line 15: Insert a period after --invention--

Column 10, line 53: Delete "and,"; insert --and--

Column 10, line 57: Delete "i s"; insert --is--

Column 11, line 6: Delete "2 12"; insert --212--

Column 11, line 39: Insert a period after --infiltration--

Column 11, line 41: Insert a period after --3A--

Column 11, line 52: Insert a period after --FIG. 3A--

Column 11, line 54: Insert a period after --invention--

Column 12, line 26: Insert a period after --configuration--

Column 12, line 33: Delete "fail"; insert --fall--

Signed and Sealed this

Fifteenth Day of November, 1994

*Attest:*

Bruce Lehman

BRUCE LEHMAN

*Attesting Officer*

*Commissioner of Patents and Trademarks*